US007059448B2

(12) United States Patent
Beechler

(10) Patent No.: US 7,059,448 B2
(45) Date of Patent: Jun. 13, 2006

(54) LADDER ACCESSORY FOR HOLDING PAPER AND TAPE

(76) Inventor: Michael Beechler, 13210 Harbor Blvd., PMB 210, Garden Grove, CA (US) 92843

( * ) Notice: Subject to any disclaimer, the term of this patent is extended or adjusted under 35 U.S.C. 154(b) by 33 days.

(21) Appl. No.: 10/926,165

(22) Filed: Aug. 26, 2004

(65) Prior Publication Data

US 2006/0054394 A1 Mar. 16, 2006

(51) Int. Cl.
*E04G 1/00* (2006.01)
*E04G 3/00* (2006.01)

(52) U.S. Cl. ..... 182/129; 248/229.22; 211/59.1

(58) Field of Classification Search ..... 182/129, 182/230, 121, 122; 248/210, 238, 229.22, 248/228.3, 230.5, 231.4; 211/59.1, 86.01, 211/89.01
See application file for complete search history.

(56) References Cited

U.S. PATENT DOCUMENTS 1,349,225 A * 8/1920 Rosenblum ..... 248/231.41
1,944,343 A * 1/1934 Herman ..... 248/316.1
3,511,338 A 5/1970 Chapman
3,567,557 A 3/1971 Kingery et al.
3,661,351 A 5/1972 Olsen
3,950,214 A 4/1976 Pool et al.
4,482,030 A 11/1984 Lincourt
D277,622 S * 2/1985 Servadio ..... D6/521
4,583,269 A * 4/1986 Harris ..... 24/495
4,899,970 A 2/1990 Berzina
4,964,601 A 10/1990 Dishman
4,979,710 A 12/1990 Baldwin
5,342,008 A 8/1994 Kay
D354,431 S 1/1995 Andrews
5,421,428 A 6/1995 Ingles
5,584,458 A * 12/1996 Rando ..... 248/231.41
5,740,883 A * 4/1998 Trank ..... 182/129
5,775,633 A 7/1998 Zane
6,098,748 A * 8/2000 Harper et al. ..... 182/129
6,206,332 B1 * 3/2001 Middendorp et al. .... 248/316.1
6,334,509 B1 * 1/2002 Ryszkiewicz ..... 182/129
6,398,175 B1 * 6/2002 Conner et al. ..... 248/228.3
6,688,570 B1 * 2/2004 Mundt ..... 248/238
6,736,358 B1 * 5/2004 Johnson ..... 248/125.3
6,837,338 B1 * 1/2005 Grover ..... 182/107
6,962,234 B1 * 11/2005 Reeves ..... 182/36

* cited by examiner

*Primary Examiner*—Hugh B. Thompson, II
(74) *Attorney, Agent, or Firm*—Donald R. Schoonover

(57) ABSTRACT

An accessory includes a handle-operated clamp and is mounted on a rail of a ladder, such as an extension ladder, to hold paper and tape in position to be easily accessed by a worker balancing on the ladder.

2 Claims, 1 Drawing Sheet

LADDER ACCESSORY FOR HOLDING PAPER AND TAPE

BACKGROUND OF THE INVENTION

1. Field of the Invention

The present invention relates to the general art of ladders, and to the particular field of accessories for ladders.

2. Discussion of the Related Art

Many tasks require the use of an extension ladder to complete. Just about any work on or near the ceiling of a room will require a ladder.

Using a ladder while performing a task may require skill, balance and dexterity. These traits can, and are, generally acquired by workers and craftsmen. However, no matter how proficient a worker is, he must still have some part of his concentration directed to maintaining his balance on the ladder while competing a task.

For example, a paper hanger must balance on a ladder while feeding paper from a roll, applying adhesive, and keeping the paper in place. While many paper hangers successfully achieve these goals, it would make their jobs easier if one or more of these tasks could be carried out by an accessory.

Therefore, there is a need for an accessory for a ladder that will permit a worker to direct most of his concentration to completing the task.

More specifically, there is a need for an accessory for a ladder that will assist a paper hanger in directing as much of his concentration on the task of hanging paper as possible.

Any accessory that is intended to make a task easier should not require a great deal of work to set up, or its objective will be vitiated. Therefore, there is a need for an accessory for a ladder that will assist a paper hanger in directing as much of his concentration on the task of hanging paper as possible and which is easy to assemble and to disassemble from a ladder.

To be most effective, any accessory that is intended to hold work items on a ladder must hold those items in the most convenient location on the ladder where those items will be easily accessible to a worker balancing on the ladder. Otherwise, the objectives of the accessory may be defeated.

Therefore, there is a need for an accessory for a ladder that will assist a paper hanger in directing as much of his concentration on the task of hanging paper as possible and will locate the items needed for the task in a position that is most convenient for the worker.

Principal Objects of the Invention

It is a main object of the present invention to provide an accessory for a ladder that will permit a worker to direct most of his concentration to completing the task.

It is another object of the present invention to provide an accessory for a ladder that will assist a paper hanger in directing as much of his concentration on the task of hanging paper as possible.

It is another object of the present invention to provide an accessory for a ladder that will assist a paper hanger in directing as much of his concentration on the task of hanging paper as possible and which is easy to assemble and to disassemble from a ladder.

It is another object of the present invention to provide an accessory for a ladder that will assist a paper hanger in directing as much of his concentration on the task of hanging paper as possible and will locate the items needed for the task in a position that is most convenient for the worker.

SUMMARY OF THE INVENTION

These, and other, objects are achieved by an accessory that includes a trigger-operated clamp, a paper supporting roller, a masking tape holder, a paper cutter, and a tape cutter.

The accessory is easily clamped onto a rail of an extension ladder and will support paper and tape in position to be easily reached and easily manipulated by a worker balancing on the ladder. After a job has been completed, the accessory embodying the present invention is easily removed from the ladder.

BRIEF DESCRIPTION OF THE DRAWING FIGURES

DETAILED DESCRIPTION OF THE PREFERRED EMBODIMENT

Figure 2:
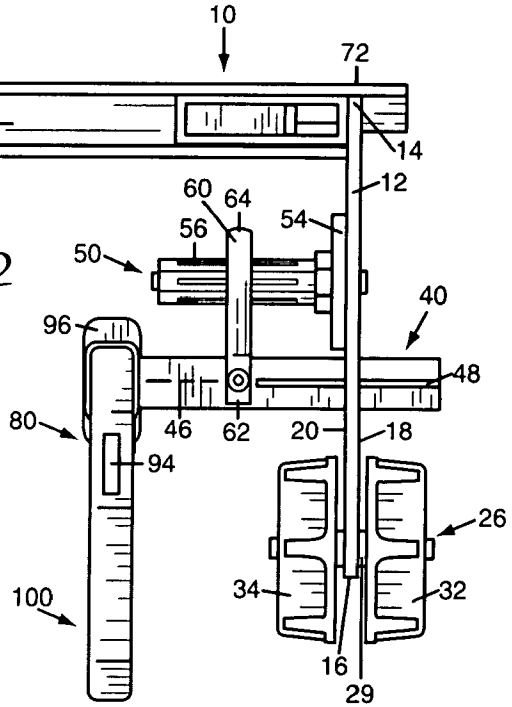
FIG. 2 is a side elevational view of an accessory for use on a ladder during a paper hanging operation.
Figure 1:
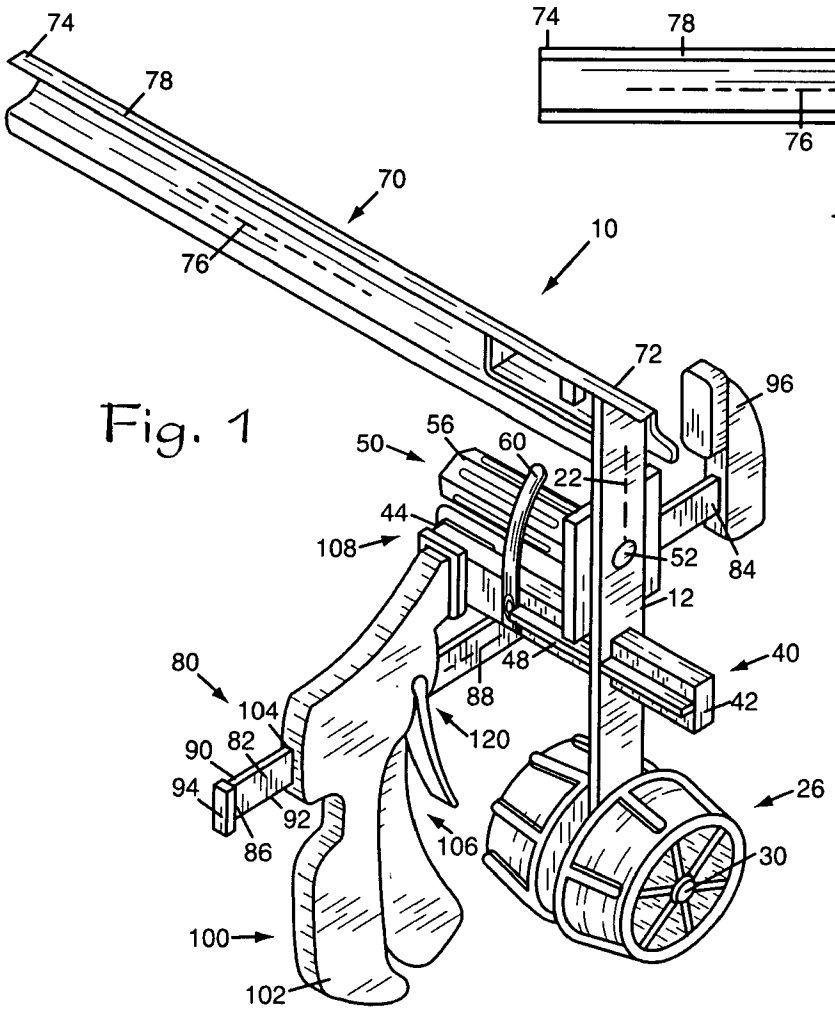
FIG. 1 is a perspective view of an accessory for use on a ladder during a paper hanging operation.

Other objects, features and advantages of the invention will become apparent from a consideration of the following detailed description and the accompanying drawings.

Referring to the Figures, it can be understood that the present invention is embodied in an accessory 10 for use on a ladder to support paper and tape rolls on the rail of the ladder in a position that is convenient to a user.

Accessory 10 comprises a central support bar 12 which has a first end 14, a second end 16, a first side wall 18, a second side wall 20, and a longitudinal axis 22 which extends between first end 14 and second end 16.

A tape roll-supporting unit 26 is mounted on second end 16 of central support bar 12. Tape roll-supporting unit 26 includes an axle 30 mounted on support bar 12 and which extends between first and second side walls 18 and 20 of support bar 12 and transversely to longitudinal axis 22 of the support bar 12. A first tape roll holder 32 is rotatably mounted on the axle 29 adjacent to first side wall 18, and a second tape roll holder 34 is rotatably mounted on axle 30 adjacent to second side wall 20 of the support bar 12.

Tape mounted on the tape roll-supporting unit 26 will be fed off the rolls in a manner known to those skilled in the art.

A tape cutter element 40 is mounted on support bar 12 and includes a first end 42 located adjacent to first side wall 18 of the support bar 12, a second end 44 located adjacent to second side wall 20 of the support bar 12, and a longitudinal axis 46 which extends between first end 42 and second end 44 of tape cutter element 40 and which is oriented to extend transversely of longitudinal axis 22 of support element 12. A cutting edge 48 is on tape cutter element 40 and is used to cut lengths of tape in a manner known to those skilled in the art.

A paper roll holder element 50 is mounted on supporting bar 12 adjacent to first end 14 of the supporting bar 12. Element 50 includes a mounting bolt 52 fixed to supporting bar 12, a base element 54 in abutting contact with second side wall 20 of supporting bar 12 and is fixed to mounting bolt 52.

A roller element 56 is rotatably mounted on mounting bolt 52 and paper rolls are supported on the roller element 56 in a manner known to those skilled in the art.

A paper control arm 60 has a first end 62 pivotally fixed to tape cutter element 40 and a second end 64 located adjacent to roller element 56. As can be understood from the Figures, paper roll holder element 50 extends parallel to tape cutter element 40.

A paper cutting blade 70 is mounted on first end 14 of supporting bar 12 and includes a first end 72 fixed to supporting bar 12, a second end 74, and a longitudinal axis 76 which extends between first end 72 and second end 74 of paper cutting blade 70 and which is oriented to be parallel to paper roll holder element 50 and to extend transversely to longitudinal axis 22 of supporting element 12.

A paper cutting edge 78 is located on paper cutting blade 70 to cut paper drawn thereover in a manner known to those skilled in the art.

A ladder attachment unit 80 includes a main bar 82 slidably mounted on tape cutter element 40 adjacent to second end 44 of the tape cutter element 40. Main bar 82 includes a first end 84, a second end 86, and a longitudinal axis 88 which extends between first end 84 and second end 86 of the main bar 82 and is oriented transversely of longitudinal axis 46 of tape cutter element 40 and transversely of longitudinal axis 22 of supporting element 12.

Main bar 82 further includes a first edge 90 which is a top edge when ladder attachment unit 80 is in use, a second edge 92 which is a bottom edge when ladder attachment unit 80 is in use, a stop element 94 on second end 84 of the main bar 82, and a first ladder-engaging clamp element 96 located on first end 84 of the main bar 82.

A handle unit 100 is mounted on main bar 82 and includes a hand-held element 102 having a bore 104 defined therethrough and through which main bar 82 is slidably accommodated. Unit 100 further includes a trigger element 106 pivotally mounted on hand-held element 102, and a second ladder engaging-clamp element 108 on the hand-held element 102. Second ladder-engaging clamp element 108 is oriented to face first ladder-engaging element 96 with a rail of a ladder interposed therebetween when ladder attachment unit 10 is in use.

A mechanism 120, such as a ratchet and pawl mechanism, or other such mechanism that is known to those skilled in the art, connects trigger element 106 to main bar 82 of ladder attachment unit 80 in a manner such that operation of the trigger element 106 causes the main bar 82 to move first ladder-engaging clamp element 96 toward second ladder-engaging clamp element 108 to clamp the rail of the ladder therebetween and mount unit 10 on the rail of the ladder.

Operation of unit 10 can be understood by one skilled in the art based on the teaching of the foregoing disclosure, and thus will not be discussed in detail. Unit 10 is located on the rail of a ladder in a chosen position, trigger element 106 is operated to draw clamp element 96 toward clamp element 108 and clamp the rail of the ladder therebetween. Paper is mounted on unit 50 and tape on unit 26. Paper is drawn over cutting edge 76 and cut when a desired length of paper is drawn. Tape is drawn off tape rolls and cut using cutting edge 46 for use with the paper. When a job is completed, unit 10 can be disassembled from the ladder and moved to a position convenient for the next job.

It is understood that while certain forms of the present invention have been illustrated and described herein, it is not to be limited to the specific forms or arrangements of parts described and shown.

The invention claimed is:

1. An accessory for use on a ladder comprising:

(a) a central support bar which has a first end, a second end, a first side wall, a second side wall, and a longitudinal axis which extends between the first end and the second end of said support bar;

(b) a tape roll-supporting unit on the second end of said support bar, said tape roll-supporting unit including
  (1) an axle mounted on said support bar and extending between the first and second side walls of the support bar and transversely to the longitudinal axis of said support bar,
  (2) a first tape roll holder rotatably mounted on the axle adjacent to the first side wall of said support bar, and
  (3) a second tape roll holder rotatably mounted on the axle adjacent to the second side wall of said support bar;

(c) a tape cutter element mounted on said support bar and including
  (1) a first end located adjacent to the first side wall of said support bar,
  (2) a second end located adjacent to the second side wall of said support bar,
  (3) a longitudinal axis which extends between the first end of said tape cutter element and the second end of said tape cutter element and which is oriented to extend transversely of the longitudinal axis of said support bar, and
  (4) a cutting edge on said tape cutter element;

(d) a paper roll holder element mounted on said support bar adjacent to the first end of said support bar and including
  (1) a mounting bolt fixed to said support bar,
  (2) a base element in abutting contact with the second side wall of said support bar and fixed to the mounting bolt,
  (3) a roller element rotatably mounted on the mounting bolt,
  (4) a paper control arm having a first end pivotally fixed to said tape cutter element and a second end located adjacent to the roller element, and
  (5) said paper roll holder element extending parallel to said tape cutter element;

(e) a paper cutting blade mounted on the first end of said support bar and including
  (1) a first end fixed to said support bar,
  (2) a second end,
  (3) a longitudinal axis which extends between the first end of said paper cutting blade and the second end of said paper cutting blade and which is oriented to be parallel to said paper roll holder element and to extend transversely to the longitudinal axis of said support bar, and
  (4) a paper cutting edge on said paper cutting blade;

(f) a ladder attachment unit which includes
  (1) a main bar slidably mounted on said tape cutter element adjacent to the second end of said tape cutter element, the main bar including
    (A) a first end,
    (B) a second end,
    (C) a longitudinal axis which extends between the first end of the main bar and the second end of the main bar and is oriented transversely of the longitudinal axis of said tape cutter element and transversely of the longitudinal axis of said support bar,
    (D) a first edge which is a top edge when said ladder attachment unit is in use,
    (E) a second edge which is a bottom edge when said ladder attachment unit is in use, and
    (F) a stop element on the second end of the main bar,
  (2) a first ladder-engaging clamp element on the first end of the main bar, (3) a handle unit on the main bar and including (A) a hand-held element having a bore defined therethrough and through which the main bar is slidably accommodated, (B) a trigger element pivotally mounted on the hand-held element, and (C) a second ladder-engaging clamp element on the hand-held element, the second ladder-engaging clamp element being oriented to face the first ladder-engaging element with a rail of a ladder interposed therebetween when said ladder attachment unit is in use; and (g) a mechanism connecting the trigger element of the handle unit to the main bar of said ladder attachment unit in a manner such that operation of the trigger element causes the main bar to move the first ladder-engaging clamp element toward the second ladder-engaging clamp element.

2. An accessory for use on a ladder comprising:

(a) a central support bar;

(b) a tape roll-supporting unit on said central support bar, said tape roll-supporting unit including two tape roll holders;

(c) a tape cutter element mounted on said support bar;

(d) a paper roll holder element mounted on said support bar and including a paper control arm pivotally fixed to said tape cutter element;

(e) a paper cutting blade mounted on said support bar;

(f) a ladder attachment unit which includes (1) a main bar slidably mounted on said tape cutter element bar and including a stop element and a first ladder-engaging clamp element, (2) a handle unit on the main bar and including (A) a hand-held element having a bore defined therethrough and through which the main bar is slidably accommodated, (B) a trigger element pivotally mounted on the hand-held element, and (C) a second ladder-engaging clamp element on the hand-held element, the second ladder-engaging clamp element being oriented to face the first ladder engaging element with a rail of a ladder interposed therebetween when said ladder attachment unit is in use; and (g) a mechanism connecting the trigger element of the handle unit to the main bar of said ladder attachment unit in a manner such that operation of the trigger element moves the main bar to move the first ladder-engaging clamp element toward the second ladder-engaging clamp element.

* * * * *